United States Patent [19]

Gruenwald

[11] Patent Number: 4,597,692

[45] Date of Patent: Jul. 1, 1986

[54] REHABILITATED MANHOLE COVER

[75] Inventor: James D. Gruenwald, Menomonee Falls, Wis.

[73] Assignee: Clearwater Technologies, Inc., Menomonee Falls, Wis.

[21] Appl. No.: 630,262

[22] Filed: Jul. 12, 1984

[51] Int. Cl.[4] ..... E02D 29/14

[52] U.S. Cl. ..... 404/25; 52/20; 220/287; 220/307

[58] Field of Search ..... 404/25, 26; 52/19–21; 220/287, 209; 137/855, 364, 371; 49/463, 466, 41; 308/4 R, 3.6; 166/241; 210/163–166

[56] References Cited

U.S. PATENT DOCUMENTS

| | | | |
|---|---|---|---|
| 783,702 | 2/1905 | Olds | 404/25 |
| 1,485,512 | 3/1924 | Cocq et al. | 166/241 |
| 2,664,334 | 12/1953 | Bissmann | 308/3.6 |

FOREIGN PATENT DOCUMENTS

| | | | |
|---|---|---|---|
| 2114978 | 10/1972 | Fed. Rep. of Germany | 137/855 |
| 2938263 | 4/1981 | Fed. Rep. of Germany | 52/20 |

OTHER PUBLICATIONS

Clearwater Technologies Inc. Brochure (4 pp.), Feb. 1983.

*Primary Examiner*—James A. Leppink
*Assistant Examiner*—Matthew Smith
*Attorney, Agent, or Firm*—Andrus, Sceales, Starke & Sawall

[57] ABSTRACT

A rehabilitated manhole cover and method of producing the same. To rehabilitate the manhole cover for a sanitary sewer system, a removable plug is inserted in one of the vent holes in the cover, while a permanent seal is applied to the remaining vent holes. A pneumatic gasket is installed with an adhesive on the annular ledge in the manhole casting and the cover when installed rests on the ledge and compresses the gasket to provide a seal between the cover and the casting. To properly center the cover, holes are drilled in the peripheral edge of the cover and metal rivets installed within the holes. Each rivet is provided with an enlarged head which projects outwardly from the cover and can be spaced from the peripheral edge of the cover by shims or spacers to thereby maintain the peripheral edge of the cover is close proximity to the manhole casting. By removing the removable plug the cover can be removed from the manhole in a conventional manner by using a pick.

5 Claims, 9 Drawing Figures

REHABILITATED MANHOLE COVER

BACKGROUND OF THE INVENTION

In many localities the sanitary sewer system is overloaded due to the influx of surface water into the sewer system through manholes in the streets. The manhole is normally enclosed with a cast iron cover or lid which rests on an annular shoulder formed in the manhole casting, so that the upper surface of the cover is flush with the road surface. The conventional manhole cover contains from about four to twelve vent holes and surface water flows into the sewer system through the vent holes, as well as through the joint between the cover and the casting which is normally unsealed.

To relieve the burden on the sanitary sewer system, some municipalities have installed new manhole covers without vent holes and have attempted to seal the cover to the casting. However, new covers are costly and require disposal of the old covers, and in many cases, a retrofitted cover does not properly fit within the manhole casting, with the result that there is considerable wobble and rattling of the cover when subjected to vehicle traffic and the wobble causes wear of the cover and casting.

SUMMARY OF THE INVENTION

The invention is directed to a rehabilitated manhole cover and to a method of producing the same. Through the rehabilitation process of the invention, the cover will be sealed to thereby prevent leakage of surface water into the sanitary sewer system.

In accordance with the invention, a removable plastic plug is inserted in one of the vent holes in the manhole cover, while the remaining vent holes are permanently sealed by a plastic material, such as polyurethane. The removable plug enables the cover to be lifted from the manhole in a conventional manner. More particularly, by removing the plastic plug the cover can be lifted by use of a pick.

To seal the cover to the manhole casting, a pneumatic gasket or seal is installed with an adhesive on the supporting shoulder or ledge of the casting. The cover, which rests on the shoulder, compresses the gasket to provide a water-tight seal between the peripheral edge of the cover and the casting.

To properly center the cover with respect to the manhole, holes are drilled in the peripheral edge of the cover at an upwardly inclined angle of about 5°. Rivets made of a metal, such as stainless steel, are pressed fitting into the openings and each rivet is provided with an enlarged head that projects outwardly of the cover. In addition, spacers or shims can be positoned between the rivet head and the peripheral edge of the cover in order to properly center the cover within the manhole.

Through use of the process of the invention, the cover is sealed against the ingress of surface water into the sanitrary sewer system.

As a further advantage, due to the precise centering of the cover within the manhole and the pneumatic gasket, movement of the cover is minimized and this correspondingly reduces wear on the cover and casting, as well as substantially reducing noise due to a floppy cover.

Through the rehabilitation process of the invention, the purchase of new covers is eliminated as well as the disposal of old covers. This results in a substantial cost saving over the purchase of new manhole covers.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
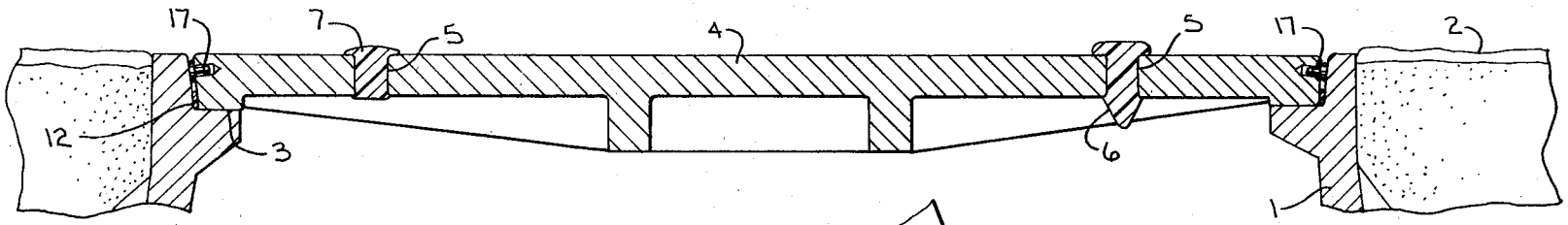
FIG. 1 is a vertical section of a rehabilitated manhole cover as installed in a manhole.

FIG. 1 shows a conventional manhole casting 1 which is located in a roadway 2 and is connected to a sanitary sewer system. Casting 1 is formed with an internal annular shoulder or ledge 3 which supports a cast manhole cover or lid 4 which has been rehabilitated according to the method of the invention.

The cover 4 is normally provided with a series of vent holes 5, and in accordance with the invention, at least one of the vent holes 5 is closed by a removable molded plastic plug 6 formed of a material such as polyurethane. The remaining vent holes 5 are permanently sealed by a sealing material 7, such as polyurethane, which is molded into the vent holes.

Figure 3:
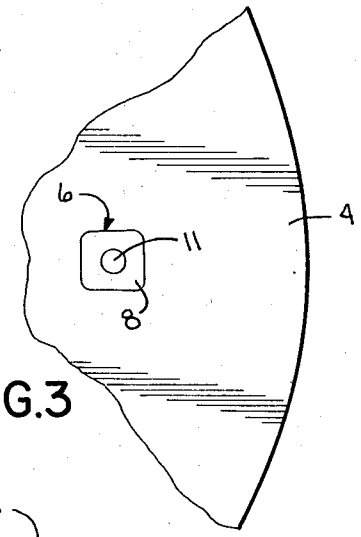
FIG. 3 is a fragmentary plan view of the manhole cover.

Removable plug 6 is formed with an upper flange 8, which as shown in FIG. 3, is generally square in configuration, and rests on the upper surface of cover 4. Plug 6 also includes a body 9 which is tapered downwardly and outwardly and press fitted with the vent hole 5. Body 9 terminates in a pointed tip 10.

Figure 4:
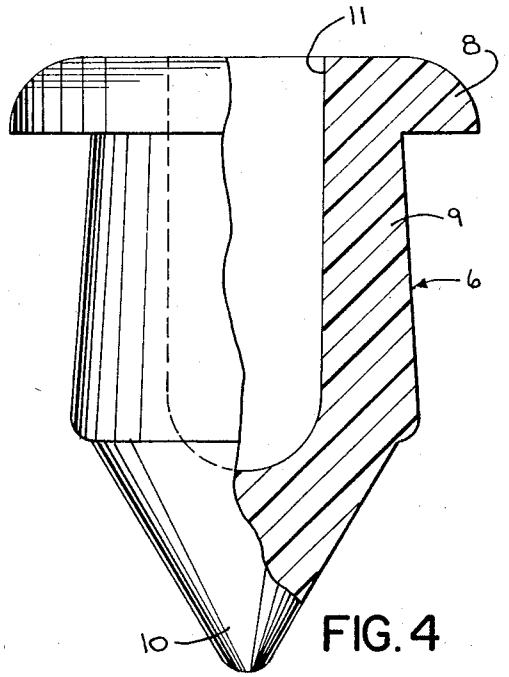
FIG. 4 is an enlarged side elevation of the removable plug with parts broken away in section.

As best illustrated in FIG. 4, the upper surface of pulg 6 is provided with a central hole 11 which aids in removal of the 50. More particularly by inserting a tool into the hole 11, the plug can be pried out of the vent hole. Through use of a pick, the cover 4 can then be lifted from the manhole in the conventional manner.

To seal the joint between the cover 4 and the casting 1, a tubular pneumatic gasket 12 is secured to the inner portion of shoulder 3 through use of an adhesive 13 or bonding agent. Gasket 12 is generally circular cross section in its uncompressed state and extends continuously around shoulder 3. When cover 4 is positioned on the shoulder 3, the peripheral edge of the cover will compress gasket 12 to provide a seal between the cover and the wall 14 of casting 1.

To properly center cover 4 within the manhole, a series of rivets 15 are mounted within holes 16 drilled in the peripheral edge of cover 4. In most cases three rivets 15 will be employed, although more rivets can be used, if desired. Each rivet 15 is provided with a generally cylindrical body 17 which is press fitted into a respective hole 16 that extends upwardly at a slight angle of about 5° to the horizontal. Body 17 terminates in an outer enlarged head 18, and one or more annular spacers or shims 19 can be inserted around the body 17 beneath head 18. The number of spacers 19 employed is sufficient to space the cover in the range of about 1/32 to 1/16th inch from the wall 14 of manhole casting 1.

Figure 5:
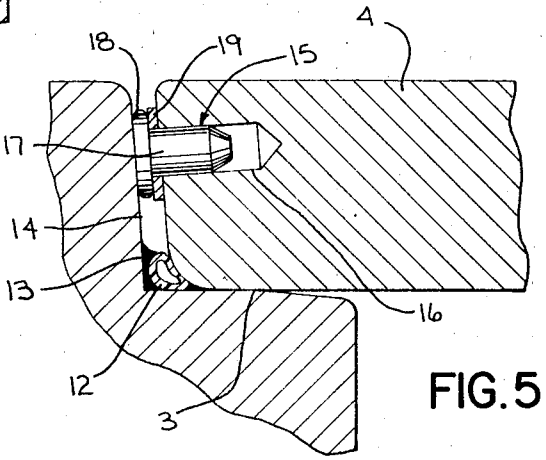
FIG. 5 is a view similar to FIG. 2 and showing the installation of a worn manhole cover.
Figure 2:
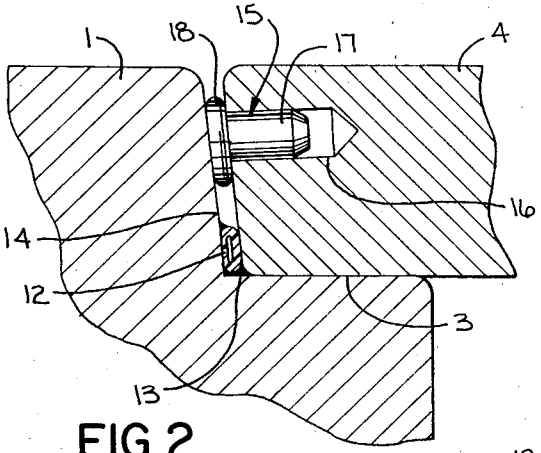
FIG. 2 is an enlarged fragmentary vertical section showing the cover and manhole casting.

In situations where there has been minimal wear of the manhole cover and casting in prior service, the cover 4 will be supported entirely on the shoulder 3 and gasket 12 will be compressed, as shown in FIG. 2, between the peripheral edge of the cover the casting wall 14. However, in situations where there has been substantial wear of the cover and casting, the cover will compress the gasket 12 against the wall 14 as well as against shoulder 3, as illustrated in FIG. 5.

In the process of rehabilitating an existing manhole cover, the vent holes 5 and the adjacent areas are initially sand blasted to provide a rough clean surface to increase the bond between the polyurethane and the cover. In addition the seat area on the shoulder 3 and wall 4 where the gasket 12 is to be applied is also sand blasted to provide a roughened clean area.

The gasket 12 is applied to the shoulder 3 with the use of adhesive 13, and the vent holes, except the one to receive the removable plug 6, are then sealed by pouring a liquid uncured polyurethane resin into the vent holes. After curing of the resin, the holes will be permanently sealed.

Following this, holes 16 are drilled in the peripheral edge of the cover and the rivets 15 and necessary spacers 19 are installed to provide precise centering of the cover 4 within the manhole casting.

The final step is to install the removable molded plug 6 in the remaining vent hole 5.

Figure 6:
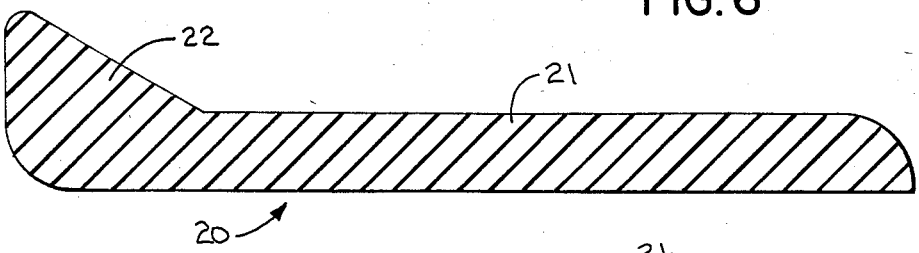
FIG. 6 is a vertical section of the flapper valve before application to the manhole cover.
Figure 7:
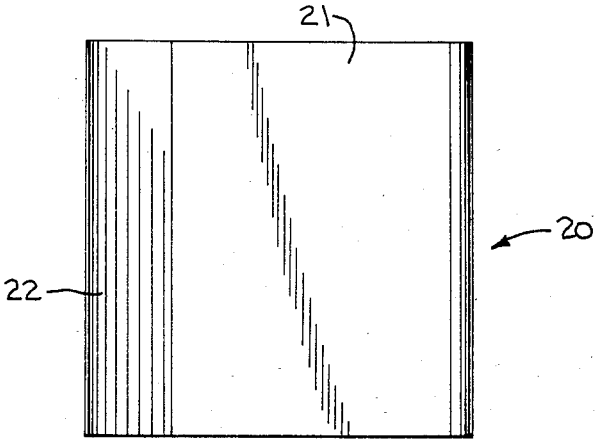
FIG. 7 is a plan view of the flapper valve.
Figure 8:
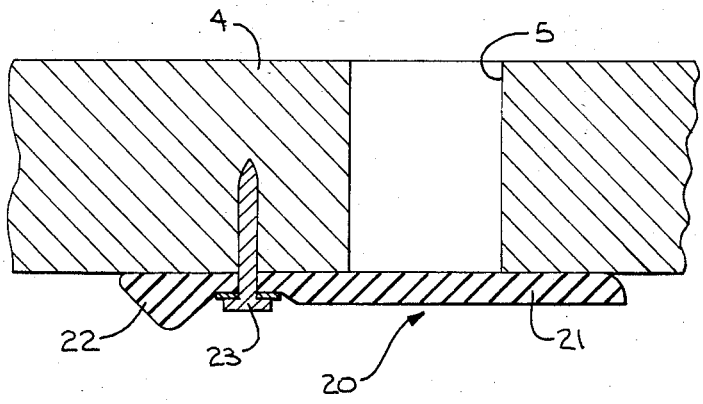
FIG. 8 is a vertical section of the flapper valve as attached to the manhole cover.

FIGS. 6–9 illustrate a modified form of the invention in which a flapper valve 20 can be substituted for the removable plug 6 of the first embodiment to enclose vent hole 5. Flapper valve 20 in its unattached state is shown in FIG. 6 and includes a generally flat body section 21 having a substantially uniform thickness and an enlarged generally triangular head 22.

Figure 9:
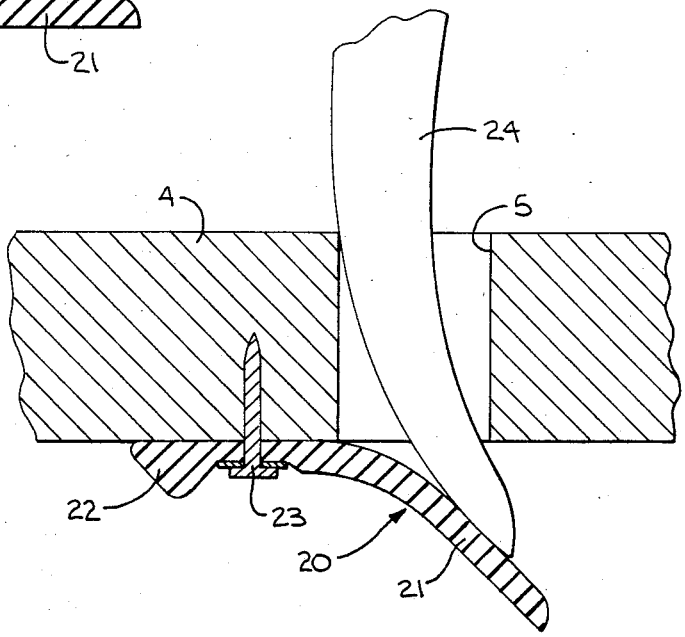
FIG. 9 is a view similar to FIG. 8 showing the removal of the manhole cover through use of a pick.

Flapper valve 20 can be applied to the undersurface of the cover through use of a fastener 23 which can be driven into the metal manhole cover 4 through use of a conventional nail gun. The valve 20 is applied to the undersurface of the cover with the tip of the large head 22 facing the cover 4. The head of the fastener 23 is inserted at the junction between body 21 and head 22 and thus will bend or deflect the valve upwardly which acts to urge the body 21 tightly against the undersurface of the cover to enclose the vent hole 5. The biasing action produced by this configuration will normally prevent water from leaking through the vent hole and opening the flap valve. However, a pick 24, when inserted through the vent hole 5, will deflect the flap valve 20 downwardly as shown in FIG. 9, so that the pick can be used to remove the cover 4 from the manhole.

With the rehabilitation process of the invention, the manhole is completely sealed against ingress of surface water into the storm sewer system. The use of the centering rivets 15 and gasket 12 insures a close tolerance fit of the cover within the manhole which minimizes movement of the cover, thereby reducing wear and substantially decreasing the noise level due to a floppy cover.

By rehabilitating and sealing the cover by the process of the invention, the purchase of new covers is eliminated, resulting in a substantial cost savings in rehabilitating the sanitary sewer system.

Various modes of carrying out the invention are contemplated as being within the scope of the following claims particularly pointing out and distinctly claiming the subject matter which is regarded as the invention.

I claim:

1. A manhole assembly, comprising a manhole casting defining a manhole and having an internal shoulder spaced from the upper edge of the casting, a cover to enclose the manhole and supported on said shoulder, a gasket disposed to seal the joint between the cover and the casting, a peripheral edge of said cover having a plurality of generally radial circumferentially spaced holes, and a spacing member disposed in each hole and projecting radially outward of the cover, each spacing member having an enlarged head terminating in a relative flat outer surface, said spacing members serving to accurately center the cover within said manhole.

2. The assembly of claim 1, wherein said cover includes a plurality of generally vertical openings extending through said cover, a removable plug disposed in at least one opening and a sealant disposed in the remaining openings to seal the same.

3. The assembly of claim 1, and including a plurality of spacers disposed between each head and the adjacent peripheral surface of said cover.

4. A rehabilitated manhole assembly, comprising a manhole casting defining a manhole and having an internal annular shoulder spaced beneath the upper end of said casting, a manhole cover to enclose the manhole and supported on said shoulder, said cover having a plurality of generally vertical vent holes extending through the cover, a removable plug disposed in at least one of said vent holes, a sealant disposed within the remaining vent holes to permanently seal the same, an annular gasket disposed on said shoulder to seal the peripheral edge portion of said cover to said casting, the peripheral edge of said cover having a plurality of radially extending holes spaced around the circumference of said cover, said holes extending at an upward angle of about 5° to the horizontal, a rivet disposed in each of said holes, each rivet comprising a stem portion disposed within the respective hole and an enlarged head located outwardly of the peripheral edge of said cover, each head terminating in a generally flat surface facing the wall of said manhole casting, said rivets serving to accurately center the cover within the manhole.

5. A rehabilitated manhole assembly, comprising a manhole casting defining a manhole and having an internal annular shoulder spaced beneath the upper end of said casting, a manhole cover to enclose the manhole and supported on said shoulder, said covering having a plurality of generally vertical vent holes extending through the cover, an operable closure disposed in at least one of said vent holes, said openable closure comprising a flap valve secured to the undersurface of said cover and enclosing said vent hole, said flap valve including a generally flat body portion of substantially uniform thickness enclosing said vent hole and an enlarged head, and a fastener extending through said valve at the juncture of said body and said head to secure said valve to said cover said enlarged head when said valve is unattached to said cover projecting upwardly toward said cover, said fastener acting to force said juncture against said cover to thereby bias said body against the undersurface of said cover.

* * * * *